US008110768B2

(12) United States Patent
Girnus et al.

(10) Patent No.: US 8,110,768 B2
(45) Date of Patent: Feb. 7, 2012

(54) METHOD FOR SORTING POSTAL ITEMS AND DATA STRUCTURE FOR A SORTING PLAN

(75) Inventors: Malte Girnus, Darmstadt (DE); Michael Harbaum, Darmstadt (DE); Michael Dressler, Langenlonsheim (DE)

(73) Assignee: Deutsche Post AG, Bonn (DE)

( * ) Notice: Subject to any disclaimer, the term of this patent is extended or adjusted under 35 U.S.C. 154(b) by 797 days.

(21) Appl. No.: 12/096,118

(22) PCT Filed: Dec. 4, 2006

(86) PCT No.: PCT/EP2006/011592

§ 371 (c)(1),
(2), (4) Date: Jun. 4, 2008

(87) PCT Pub. No.: WO2007/065615

PCT Pub. Date: Jun. 14, 2007

(65) Prior Publication Data

US 2008/0264836 A1 Oct. 30, 2008

(30) Foreign Application Priority Data

Dec. 5, 2005 (EP) ..... 05026471

(51) Int. Cl.
*B07C 5/00* (2006.01)

(52) U.S. Cl. ..... 209/584; 209/900; 700/224; 700/226

(58) Field of Classification Search ..... 209/583, 209/584, 900; 700/223–226
See application file for complete search history.

(56) References Cited

U.S. PATENT DOCUMENTS

| | | | | |
|---|---|---|---|---|
| 3,889,811 | A | 6/1975 | Yoshimura | |
| 4,507,739 | A | 3/1985 | Haruki et al. | |
| 5,119,954 | A | 6/1992 | Svyatsky et al. | |
| 5,593,044 | A | 1/1997 | Yamashita et al. | |
| 5,667,078 | A * | 9/1997 | Walach | 209/584 |
| 6,274,836 | B1 | 8/2001 | Walach | |

(Continued)

FOREIGN PATENT DOCUMENTS

DE 10112186 A1 10/2002

(Continued)

OTHER PUBLICATIONS

PCT International Preliminary Report on Patentability, International Application No. PCT/EP2006/011592, International Filing Date Dec. 4, 2006, International Patent Classification, Translation.
English Language Abstract of Article "Das Codieren von Briefanschriften", vol. 18/60, 1960, pp. 682-688.

*Primary Examiner* — Joseph C Rodriguez
(74) *Attorney, Agent, or Firm* — International IP Law Group, PLLC

(57) ABSTRACT

There is provided a method and system for sorting mailpieces in which a mailpiece is diverted into a sorting compartment of a sorting machine as a function of a sorting code associated with the mailpiece, where several sorting code ranges are each associated with a sorting compartment. An exemplary method comprises associating at least one first sorting code range with at least another sorting code range which is a subrange of the first sorting code range and checking consecutively for the sorting code ranges associated with each other whether the sorting code belongs to the sorting code range. The exemplary method further includes diverting the mailpiece into the sorting compartment that is associated with the last sorting code range for which the sorting code belongs to the sorting code range.

12 Claims, 2 Drawing Sheets

U.S. PATENT DOCUMENTS

| | | | | |
|---|---|---|---|---|
| 6,829,369 | B2 * | 12/2004 | Poulin et al. | 382/101 |
| 2001/0010334 | A1 | 8/2001 | Park et al. | |
| 2002/0113365 | A1 | 8/2002 | Britton et al. | |
| 2004/0040898 | A1 | 3/2004 | Kechel | |

FOREIGN PATENT DOCUMENTS

| | | | |
|---|---|---|---|
| EP | 0661106 | A2 | 7/1995 |
| GB | 1233712 | | 5/1971 |
| WO | WO99/07487 | A1 | 2/1999 |

* cited by examiner

METHOD FOR SORTING POSTAL ITEMS AND DATA STRUCTURE FOR A SORTING PLAN

CROSS REFERENCE TO RELATED APPLICATIONS

Pursuant to 35 U.S.C. §371, this application is the United States National Stage Application of International Patent Application No. PCT/EP2006/011592, filed on Dec. 4, 2006, the contents of which are incorporated by reference as if set forth in their entirety herein, which claims priority to EP Patent Application No. 05026471.2, filed Dec. 5, 2005, the contents of which are incorporated by reference as if set forth in their entirety herein.

BACKGROUND

The sorting of mailpieces is normally carried out as a function of sorting codes in which the address of the mailpieces is encoded. The sorting code is applied onto the mailpieces in machine-readable form, for example, as a barcode, after the delivery address has been detected. Once the mailpiece reaches a sorting machine, the sorting code is detected and the mailpiece is diverted into a sorting compartment associated with that sorting code.

In the postal code system normally used in Germany, the sorting code has, for example, eleven digits, whereby the first five digits correspond to the postal code contained in the delivery address, designating a so-called delivery district group comprising several delivery districts which, in turn contain the street sections within a town that are serviced by a single mail carrier. The next three digits contain encoded information about the street designation contained in the delivery address, whereby it can be provided, for example, that the street sections of a delivery district group are consecutively numbered in a prescribed manner. The last three digits of the sorting code correspond to the last three digits of the house number indicated in the delivery address.

The sorting of mailpieces is normally carried out in a method having at least two stages. First of all, the mailpieces dropped off in a given region are collected in a distribution center of a postal service provider associated with this region and, within the scope of the outgoing sorting, they are especially distributed among the distribution centers in the destination regions of the mailpieces. In these distribution centers, within the scope of the so-called incoming sorting, a fine sorting of the mailpieces is carried out during which they are distributed among the individual delivery districts in the destination region. Normally, the incoming sorting also comprises a sorting of the mailpieces according to the sequence in which the mail carriers provide service to the delivery points of the delivery districts.

In order to carry out the sorting as efficiently as possible and to prepare the incoming sorting, it is normally provided that the sorting depth during the outgoing sorting, that is to say, the number of digits of the sorting code that are relevant for the sorting, sometimes goes beyond the postal code or the first five digits of the sorting code. In this manner, for example, mailpieces for certain street sections of a delivery district or of a delivery district group can already be combined during the incoming sorting, said mailpieces being sorted during the incoming sorting in a machine inlet according to the sequence of the delivery route, or else mailpieces for a subrange of a delivery district or of a delivery district group can be diverted into a sorting compartment together with mailpieces for another delivery district group, in order to utilize the capacity of the sorting machine as effectively as possible. However, at times, the sorting is merely carried out according to the postal code or according to the first five digits of the sorting code.

The association of the sorting codes with the sorting compartments of a sorting machine is normally carried out on the basis of a so-called sorting plan that is read out by the sorting machines. On the basis of the structure of the sorting explained above, the sorting plans according to the state of the art normally comprise two lists, one of which contains the associations between postal codes or the first five digits of the sorting code and sorting compartments and is relevant for the sorting of the mailpieces for which only a sorting depth corresponding to the postal code is provided. The second list comprises the associations between complete sorting codes or intervals of complete sorting codes and sorting compartments for the sorting of mailpieces for which a sorting depth corresponding to the complete sorting code is provided.

In order to determine the sorting compartment for a mailpiece with a prescribed sorting code, the list that comprises the postal codes has to be checked so that it can be ascertained whether the first five digits of the prescribed sorting code correspond to one of the postal codes in the list. Furthermore, the list containing the complete sorting codes likewise has to be searched in order to check whether here, too, the prescribed sorting code corresponds to a sorting code contained in the list.

This has the drawback that the list of the postal codes as well as the list with the complete sorting codes have to be searched in order to determine the sorting compartment into which a mailpiece with a prescribed sorting code has to be diverted, which is very complicated and thus very time-consuming.

SUMMARY OF THE INVENTION

Therefore, it is an objective of an exemplary embodiment of the present invention to allow a simpler and more efficient determination of a sorting compartment associated with a sorting code.

Accordingly, it is provided that a method of the above-mentioned type is carried out in that several sorting code ranges are each associated with a sorting compartment and at least one first sorting code range is associated with at least another sorting code range which is a subrange of the first sorting code range, in that, for the sorting code ranges associated with each other, it is checked consecutively, whether the sorting code belongs to the sorting code range, and in that the mailpiece is diverted into the sorting compartment that is associated with the last sorting code range for which the sorting code belongs to the sorting code range.

The data structure according to an exemplary embodiment of the present invention for a sorting plan for sorting a mailpiece, whereby the sorting plan comprises an association between a sorting code associated with the mailpiece and a sorting compartment of a sorting machine, is characterized in that it contains several sorting code ranges which are each associated with a sorting compartment, in that it comprises at least two hierarchical levels, whereby at least one first sorting code range is indicated in a first hierarchical level, and at least a second sorting code range associated with the first sorting code range is indicated in a lower hierarchical level, and in that the sorting code is associated with the sorting compartment that is associated with the sorting code range that is indicated in the lowest hierarchical level in which the sorting code belongs to the indicated sorting code range.

In this context, a sorting code range refers to a set of sorting codes that have one or more prescribed properties. According to the usual definition of a set, a sorting code range can contain no sorting code or can comprise at least one sorting code. Correspondingly, a subrange of a sorting code range refers to a set of sorting codes that additionally have other properties, whereby the set is either empty or comprises at least one sorting code. As a property, in particular, it can be prescribed that a postal code lies within a prescribed interval or that the number corresponding to the last three digits of the house number lies within a prescribed interval.

An exemplary embodiment of the present invention makes it easier and faster to ascertain whether a prescribed sorting code belongs to a certain sorting code range that is associated within the sorting plan with a sorting compartment of a sorting machine, which is achieved in that sorting code ranges and subranges associated with them are defined for which it is successively checked, whether the sorting code belongs to the sorting code ranges and to the subranges, and in that the mailpiece is assigned to the sorting compartment that is associated with the last sorting code range or subrange to which the sorting code belongs.

Thus, in order to ascertain whether a prescribed sorting code belongs to a certain sorting code range, first of all, the sorting code range is determined that contains sorting codes that, in terms of a first property, correspond to the prescribed sorting code. Then, on the basis of this sorting code range, the subrange is determined that encompasses sorting codes that, in terms of a second property, also correspond to the prescribed sorting code.

Therefore, in the second step, the sorting codes that already differ from the prescribed sorting code in terms of the first property are no longer taken into account in the evaluation, as a result of which a very efficient evaluation of a sorting plan is made possible.

An exemplary embodiment of the present invention provides a relatively simple sorting plan on the basis of the hierarchical structure. This facilitates the generation of the sorting plan as well as any procedures for checking its correctness that might be carried out.

In an especially preferred embodiment of the method according to an exemplary embodiment of the present invention and of the data structure according to an exemplary embodiment of the present invention, it is provided that the sorting code is a numerical code and that a sorting code range encompasses all of the sorting codes in which a number, which consists of at least one digit that is located in a prescribed position in the sorting code, lies within a prescribed interval.

In this manner, a hierarchical structure present within the sorting code can be taken over within the sorting plan in a simple manner. As a rule, this hierarchy corresponds to the infrastructure comprising the various administrative units, said infrastructure forming the basis of the transportation of the mailpieces from a source region to a destination region and of the delivery of the mailpieces within the destination region.

Within the scope of an exemplary embodiment of the present invention, the term interval refers to an interval of integers that contain either no element or at least one element.

In another preferred embodiment of the method according to an exemplary embodiment of the present invention and of the data structure according to an exemplary embodiment of the present invention, it is provided that a first sorting code range is associated with another sorting code range encompassing all of the sorting codes, which belong to the first sorting code range and in which a number that is made up of at least one digit that is located in at least one position of the sorting code following the prescribed position lies within a prescribed interval.

In this manner, the first sorting code range that corresponds to a certain level of the infrastructure can be associated with subranges that designate administrative units in a lower level of the infrastructure.

An especially advantageous embodiment of the method according to an exemplary embodiment of the present invention and of the data structure according to an exemplary embodiment of the present invention is characterized in that it is a p-digit numerical sorting code having the form $n_1 \ldots n_p$ wherein $n_i \in \{0, \ldots, 9\}$ and $1 \leqq I \leqq p$, and in that a first sorting code range encompasses all of the sorting codes in which the number $n_1 \ldots n_x$ is not smaller than a first number and not greater than a second number, whereby x is an integer where $1 \leqq x < p$.

Another advantageous embodiment of the method according to an exemplary embodiment of the present invention and of the data structure according to an exemplary embodiment of the present invention comprises the fact that the first sorting code range is associated with at least another sorting code range that encompasses all of the sorting codes of the first sorting code range in which the number $n_{x+1} \ldots n_y$ is not smaller than a first number and not greater than a second number, whereby y is an integer where $x < y \leqq p$.

In another advantageous refinement of the method according to an exemplary embodiment of the present invention and of the device according to an exemplary embodiment of the present invention, it is provided that the first sorting code range is associated with several additional sorting code ranges that each are a subrange of the first sorting code range, and for the second sorting code ranges it is checked in a prescribed sequence, whether the sorting code belongs to the sorting code ranges.

In this manner, the first sorting code range can be associated with several different subranges within a lower level of the infrastructure, the subranges corresponding, for example, to several administrative units that differ from each other.

An especially preferred embodiment of the method according to an exemplary embodiment of the present invention and of the data structure according to an exemplary embodiment of the present invention may be characterized in that the additional sorting code ranges associated with the first sorting code range are pairwise disjunctive.

This ensures that the association of the sorting codes with the sorting code ranges is unambiguous.

Moreover, in an especially preferred embodiment of the method according to an exemplary embodiment of the present invention and of the device according to an exemplary embodiment of the present invention, it is provided that several first sorting code ranges are each associated with at least another sorting code range, whereby the first sorting code ranges are pairwise disjunctive.

This likewise ensures an unambiguous association of a sorting code with one of the other sorting code ranges that are associated with the first sorting code range.

A practical embodiment of the method according to an exemplary embodiment of the present invention and of the device according to an exemplary embodiment of the present invention may be characterized in that the sorting code is an eleven-digit numerical sorting code whose first five digits correspond to a postal code contained in the delivery address of the mailpiece, whose next three digits correspond to a street section contained in the delivery address and whose last three digits correspond to a house number contained in the delivery address.

Preferably, it is provided that a first sorting code range encompasses all of the sorting codes in which the postal code lies within a prescribed postal code range. Here, the term postal code range is to be understood as an interval of postal codes.

Moreover, it is preferably provided that a second sorting code range associated with the first sorting code range encompasses all of the sorting codes of the first sorting code range in which the street section corresponds to one of several prescribed street sections.

Moreover, it is preferably provided that the second sorting code range is associated with a third sorting code range that encompasses all of the sorting codes of the second sorting code range in which the number formed from the last three digits of the house number lies within a prescribed house number range.

Thus, the method according to an exemplary embodiment of the present invention and the data structure according to an exemplary embodiment of the present invention are advantageously configured in such a way that, within a sorting plan, the structure that is imaged is the one that also normally exists within the sorting code.

Moreover, within the scope of an exemplary embodiment of the present invention, a device is provided for sorting mailpieces in which the mailpieces can be diverted into sorting compartments as a function of sorting codes associated with the mailpieces, whereby the sorting compartments can be associated with the sorting codes on the basis of a sorting plan, said device being characterized in that the sorting plan is stored in a storage means connected to the sorting machine and in that the sorting plan contains a data structure that is configured in the manner described above.

In an advantageous embodiment, it is provided that the device is connected to the storage means via a data network.

Another advantageous exemplary embodiment of the present invention provides that the sorting plan can be transferred from the storage means to the sorting machine, whereby the data structure of the sorting plan can be adapted to the sorting machine.

In a likewise advantageous exemplary embodiment of the present invention, it is provided that the storage means is arranged in the vicinity of the device.

DETAILED DESCRIPTION OF SPECIFIC EMBODIMENTS

Figure 1:
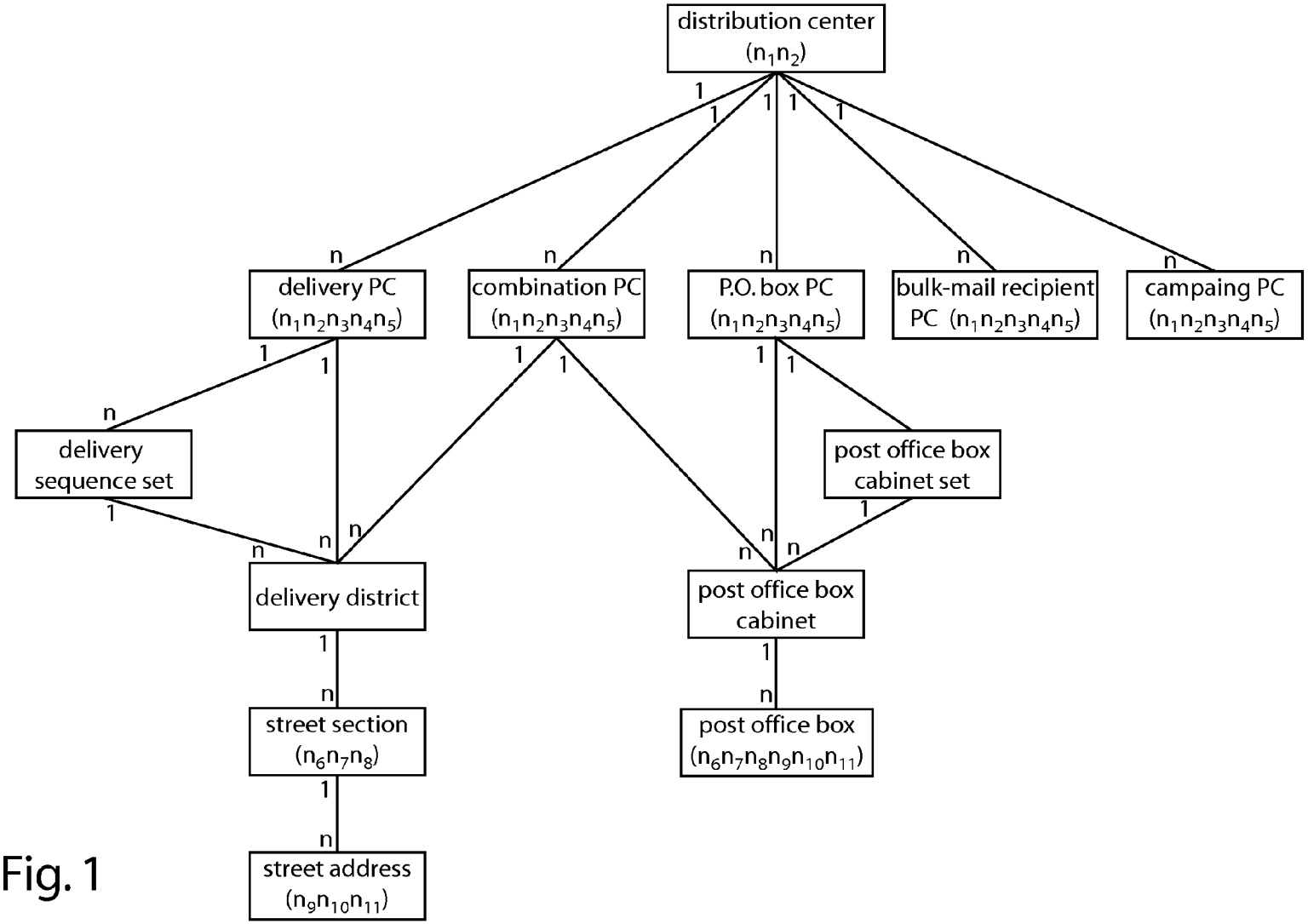
FIG. 1 is a diagram in which the relationships between various postal entities in accordance with an exemplary embodiment of the present invention are shown.

The sorting of mailpieces, as already explained above, normally takes place within the scope of a method having at least two stages comprising the outgoing sorting in a distribution center of a postal service provider associated with the region of origin of the mailpiece, and comprising the incoming sorting in a distribution center associated with the destination region of the mailpiece. During the outgoing sorting, the mailpieces that have arrived are distributed especially among the destination regions and taken to the distribution centers of the destination regions after the outgoing sorting has been completed. There, a fine sorting of the mailpieces is then carried out during which they are distributed among the delivery districts within the destination region and normally also sorted according to the sequence of the delivery routes in the individual delivery districts.

The outgoing sorting presorts the mailpieces for the so-called machine inlets in the incoming sorting. The machine inlets are sorting destinations under which the destinations are combined for which mailpieces are sorted together in a sorting machine during the incoming sorting. A machine inlet comprises, for example, mailpieces for several delivery districts that are sorted together in a sorting machine according to the sequence of the delivery route in which the mail carriers deliver the mailpieces in the delivery districts.

The distribution centers normally have an encoding device which recognizes the delivery address applied onto a mailpiece or the information about the street, the house number as well as the postal code and the town contained in the delivery address and converts this information into a numerical sorting code. The recognition is first carried out automatically in an OCR device (OCR: Optical Character Recognition) and—if the delivery address could not be recognized here—in a video encoding device where an image of the mailpiece surface containing the delivery address is displayed to a video encoding employee on a monitor. He or she deciphers the delivery address and enters it into an entry means, after which the address is converted into the sorting code. The sorting code is applied in machine-readable form, normally as a barcode, onto the mailpieces.

Within the sorting machines, the sorting code applied onto the mailpieces is first read in by means of a scanner. Then, on the basis of the sorting plan stored in the sorting machine, it is determined into which sorting compartment the mailpiece has to be diverted on the basis of its sorting code. Subsequently, the mailpiece is conveyed to the sorting compartment and diverted there. In this context, the association list is an integral part of a sorting plan that is loaded into the sorting machine and interpreted by it.

Regarding the sorting code, by way of an example in the description below, the sorting code as used by the applicant is one in which the delivery address is encoded in an eleven-digit numerical code. However, the person skilled in the art recognizes that, in general, an exemplary embodiment of the present invention can be carried out with any type of sorting codes and can be adapted in a simple manner to various codes that are used for the sorting of mailpieces.

Various positions within the sorting codes used by the applicant directly designate certain groupings of delivery points. Other groupings, in turn, comprise several of the groupings that can be directly derived from the sorting code.

Below, the groupings of delivery points that are relevant for the sorting of mailpieces and their relationship to the sorting code are shown making reference to FIG. 1.

FIG. 1 especially illustrates the relationships among these groupings, indicating the applicable cardinalities. For the sorting code, the generic notation $n_1 \ldots n_{11}$ is used below, whereby $n_i \epsilon \{0, \ldots, 9\}$ is a placeholder for the $i^{th}$ position of the sorting code.

The first five positions $n_1 n_2 n_3 n_5$ of the sorting code correspond to the postal code indicated in the delivery address that designates especially a delivery district group, a plurality of post office box cabinets each comprising several post office boxes, or a combination of one or more delivery district groups and one or more post office box cabinets.

Corresponding to the above-described types, a postal code is designated as the delivery postal code (delivery PC), post office box code (P.O. Box PC) or as a combination postal code (combination PC).

The first two positions $n_1n_2$ of the postal code or of the sorting code can indicate the region in which the delivery district group and/or the plurality of post office box cabinets designated by the postal code are located.

Every region and thus also every postal code is associated with exactly one distribution center.

As the figure shows, a delivery district group designated by a delivery postal code or combination postal code comprises one or more delivery districts, whereby the delivery points within one delivery district are serviced with mailpieces by exactly one mail carrier on his delivery route.

The delivery districts, in turn, comprise one or more street sections within the geographic region associated with a delivery district group. Here, each street section is associated with a three-digit code that is specified, for example, in that the street sections of the geographic region are consecutively numbered according to a prescribed scheme. Within the sorting code, this three-digit code occupies the positions $n_6n_7n_8$.

Each street section, in turn, comprises one or more street addresses that are specified by house number information contained within the sorting code in the positions $n_9n_{10}n_{11}$.

In the case of very long streets that have four-digit house numbers that are higher than 999, it is preferably provided that only the last three positions of the house number are incorporated into the sorting code in the manner described above. In conjunction with the information indicating the street section, which does not comprise more than 1000 street addresses, these house numbers are also unambiguously represented by the sorting code. For the sake of simplicity, ranges for the last three positions of the number corresponding to the house number are referred to here as house number ranges.

A post office box is associated with a six-digit number to which the last six positions of the sorting code correspond, that is to say, the positions $n_6n_7n_8n_9n_{10}n_{11}$, if the delivery point encoded therein is a post office box.

The machine inlets in the incoming sorting of mailpieces are normally linked to groupings of several delivery districts. Thus, for example, several delivery districts are combined into one delivery sequence set, whereby all of the mailpieces of a delivery sequence set are sorted together in a sorting machine according to the sequence of the delivery routes. Since one delivery sequence set does not usually encompass all of the delivery districts of a delivery district group, the delivery sequence set, which is likewise a sorting destination for the outgoing sorting, can generally not be equated with the delivery district group, which is an organizational unit of the postal service provider and which is not relevant for the sorting of mailpieces. In a similar manner, several post office box cabinets are combined into post office box cabinet sets for the sorting and they each represent a machine inlet in the incoming sorting.

Beyond the already described types of postal codes, preferably so-called bulk-mail recipient postal codes (bulk-mail recipient PC) and mailing campaign postal codes (campaign PC) are provided. In this context, a bulk-mail recipient is a recipient that regularly receives a large number of mailpieces, for example, more than 200 mailpieces per day, and to which the mailpieces are not delivered by a mail carrier in the usual manner but rather directly from the distribution center. A similar approach is used for the delivery of mailpieces that are addressed with a mailing campaign postal code that is made available to a recipient for a limited period of time if it is anticipated that an especially large amount of mail addressed to this recipient will be delivered during this period of time because of a mailing campaign such as, for example, sweepstakes.

The delivery address of mailpieces that are addressed using a bulk-mail recipient postal code or a mailing campaign postal code does not contain any additional information about the delivery point. Correspondingly, the sorting code for mailpieces that are addressed with such a postal code comprises merely the first five positions. The other positions are either omitted or they contain a prescribed character.

The description above shows that the sorting destinations that are taken into account during the sorting of the mailpieces, especially during the outgoing sorting, have to be largely described on the basis of sorting code ranges of the entire eleven-digit sorting code. Only in certain cases such as, for example, mailpieces addressed to a bulk-mail recipient, in case of mailing campaign mail or if this "coincidentally" seems to be practical in the generation of the sorting plans can a description of the sorting destinations be made on the basis of the postal code.

Within the scope of an exemplary embodiment of the present invention, the sorting plans that contain an association between the sorting codes and the sorting compartments of the sorting machines are hierarchically structured. The hierarchical levels provided in this structure relate to specific positions within the sorting code, which will be described in greater detail below.

In particular, it is provided that the sorting plans are configured as XML documents (XML: Extensible Markup Language) which are transmitted from a generation system to the distribution centers, where these documents are then loaded into the sorting machines. The sorting plans are adapted regularly to changed circumstances, for example, to added or deleted street addresses or to changed delivery districts.

Figure 2:
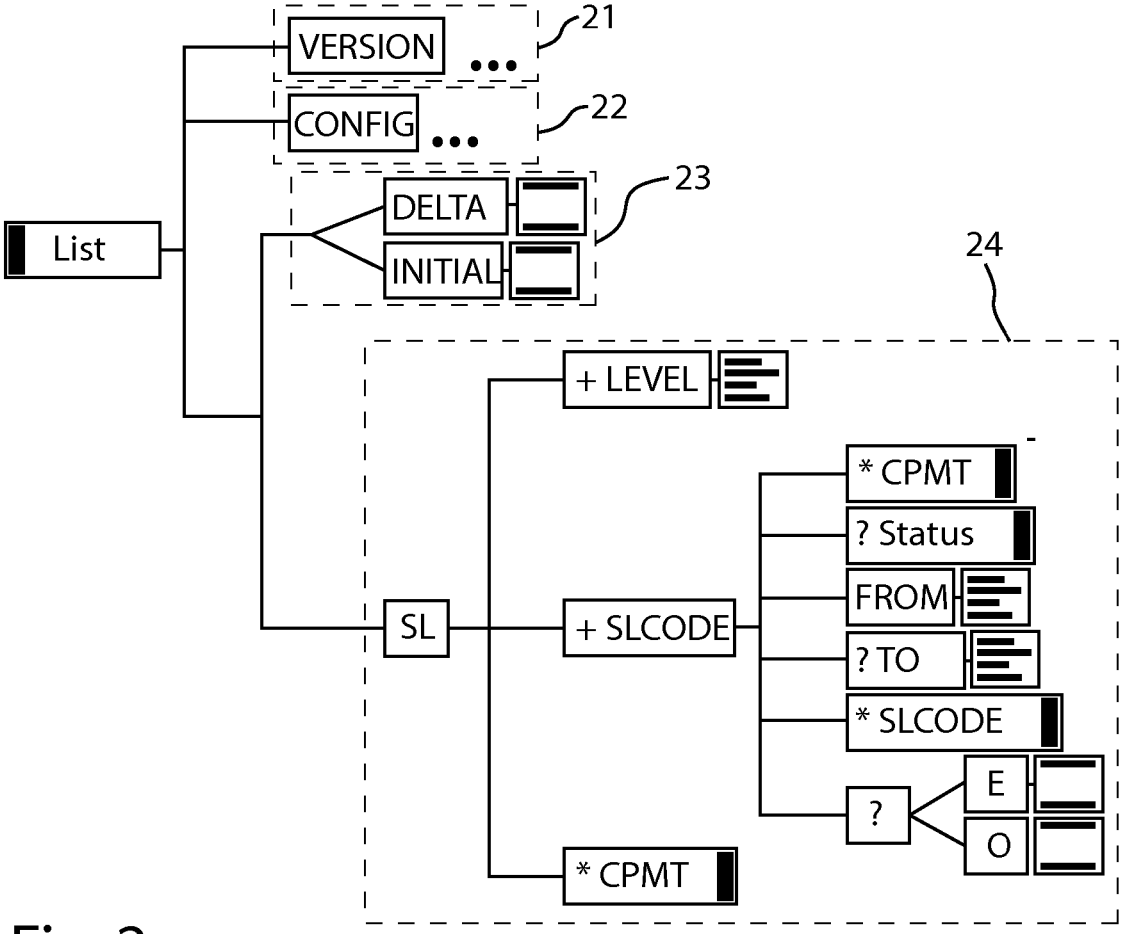
FIG. 2 is a graphic representation of a Document Type Definition (DTD) for a sorting plan with a hierarchical data structure in accordance with an exemplary embodiment of the present invention are shown.

The so-called Document Type Definition (DTD) for such a sorting plan, indicating its structure as well as the elements contained therein, is graphically illustrated in FIG. 2 in a tree diagram. It comprises a version block 21, a configuration block 22, a definition block 23 as well as the list block 24 that contains a sorting list with the associations between the sorting codes and the sorting compartments.

The version block 21, which is not elaborated upon in greater detail here, contains especially information about the version of the sorting plan and the distribution center as well as the sorting machine for which the sorting plan is intended. The version can be indicated, for example, on the basis of a consecutive number that is increased at the time of each new generation or modification, thereby unambiguously identifying the version of the sorting plan.

Various configuration parameters for the sorting machine that are relevant for the sorting are indicated in the configuration block 21, which will likewise not be discussed in greater detail here.

Within the definition block, it is indicated whether this is a complete sorting plan or whether merely modifications vis-á-vis older sorting plans are given. If the (empty) element INITIAL is contained in the DTD, then this is a complete sorting plan. If instead of the element INITIAL, the (empty) element DELTA is present, then the sorting plan is a so-called delta package, which merely contains the modifications vis-à-vis preceding sorting plans.

A delta package has the advantage that the data volume to be transmitted to the distribution centers or to the sorting machines is much smaller than the package with a complete sorting plan.

In the distribution center or within the sorting machine, however, the sorting plan has to be generated on the basis of the old sorting plan, taking into consideration the modifications indicated in the delta package, which is very time-consuming, particularly in the case of a large number of modifications. Therefore, it can be provided that, as a function of the number of modifications within the sorting plan, a decision is made to ascertain whether a new version of the sorting plan is transmitted to a distribution center in its entirety or as a delta package.

The list block 24 comprises the element SL, which contains the definition of the sorting list, that is to say, the associations between sorting codes and sorting compartments. It contains the elements LEVEL, SLCODE and moreover, it can contain the element CPMT (compartment). The XML representation of the element SL is:

```
<!ELEMENT SL (LEVEL+, SLCODE+, CPMT*)>
```

As usual, the following symbols are used in the XML representation as well as in FIG. 2:

* the element does not occur or it occurs an arbitrary number of times

+ the element occurs at least once

? the element does not occur or it occurs exactly once

| either the left element or the right element occurs

The provided hierarchical levels are specified on the basis of the element LEVEL. Here, it is provided that each hierarchical level is associated with prescribed positions of the sorting code, whereby each entry of the list indicates the number of the positions of the sorting code considered in the appertaining hierarchical level.

The topmost hierarchical level is associated with leading positions of the sorting code in the number indicated in the first list entry of the element LEVEL, the next-lower hierarchical level is associated with the following positions of the sorting code in a number indicated in the second list entry of the element LEVEL, etc.

In this manner, on the basis of the list contained in the element LEVEL, it becomes clear which positions of the sorting code are associated with a hierarchical level.

Accordingly, for example, on the basis of the list

<LEVEL>5<\LEVEL>

<LEVEL>3<\LEVEL>

<LEVEL>3<\LEVEL>, a hierarchy with three levels is defined, in which the first five positions, the following three positions and the last three positions of the sorting code are each associated with a hierarchical level, which below is also referred to as a 5,3,3 hierarchy.

The element CPMT optionally contained in the element SL describes a compartment into which mailpieces with all of the sorting codes indicated in the sorting list are diverted.

Since, as a rule, however, it is provided that various sorting code ranges are associated with different sorting compartments, this element is normally not present here.

The element SLCODE with the XML representation

```
<!ELEMENT SLCODE (CPMT*, STATUS?, FROM,
    TO?, SLCODE*, (E|O)?)
```

contains the association between sorting compartments that are indicated in the element CPMT, and sorting code ranges that are indicated on the basis of the elements FROM, TO and E or O, as will be described in greater detail below.

The element STATUS occurs with delta packages and indicates whether an association between a sorting code range should be newly established in the sorting plan (in this case, the element STATUS takes on the value of 1), whether an association that exists in the older sorting plan should be deleted (the element status takes on the value of 0) or whether an association present in the older sorting plan should be replaced by the one indicated (the element status takes on the value of 2).

For each hierarchical level provided and indicated in the element LEVEL, there is at least one element SLCODE, whereby the elements SLCODE for lower hierarchical levels are each contained in an element SLCODE of the next-higher hierarchical level. On the basis of the elements SLCODE of the lower hierarchical levels, subranges of the sorting code range are indicated, and this is described in the next-higher hierarchical level.

All of the elements SLCODE of a lower hierarchical level, which describe subranges of a sorting code range indicated in the next-higher hierarchical level, are contained in the corresponding element SLCODE of the next-higher hierarchical level.

In this manner, a structure is obtained in which ranges of the eleven-digit sorting code $n_1 \ldots n_{11}$ are defined in the topmost hierarchical level, said ranges containing the sorting codes in which the number $n_1 \ldots n_x$ lies within a prescribed interval, whereby the number x corresponds to the number of positions of the sorting code that are associated with the topmost level.

In the next-lower hierarchical level, subranges of the sorting code ranges defined in the topmost hierarchical level are defined, said ranges encompassing the sorting codes in which additionally the number $n_{x+1} \ldots n_y$ lies within a prescribed interval. The number y−x corresponds to the number of positions that are associated with the next-lower level.

In another level, in an analogous manner, subranges of these sorting code ranges can be indicated, etc.

Preferably, the sorting code ranges defined in the topmost hierarchical level are pairwise disjunctive, that is to say, a prescribed sorting code is contained in no sorting code ranges or in precisely one sorting code range. The subranges of these sorting code ranges defined in a lower hierarchical level are preferably likewise pairwise disjunctive, so that a certain sorting code range is determined by a successive evaluation of all of the hierarchical levels.

Thus, this results in a data structure in the form of a tree whose depth matches the provided number of hierarchical levels. A sorting code range defined in a certain hierarchical level is unambiguously associated with a node of the corresponding depth within the tree, whose child nodes are each associated with subranges of this sorting code range. In order to achieve an unambiguous definition of the sorting code ranges in the various hierarchical levels, the sorting code ranges associated with sibling nodes are pairwise disjunctive.

As already explained, the individual hierarchical levels are associated with prescribed positions of the sorting code. A sorting code range indicated in a hierarchical level in the element SLCODE is defined on the basis of the positions of the code that are associated with this hierarchical level. It is provided that the sorting code range encompasses all of the sorting codes in which the number that is formed from the positions of the sorting code associated with the hierarchical level lies within a prescribed interval of integers. The lower limit of this interval is indicated on the basis of the element FROM contained in the element SLCODE. The upper limit is specified on the basis of the element TO.

If the optional element TO is absent, then the interval encompasses exclusively the number indicated in the element FROM.

In order to determine the sorting code range indicated in the above-mentioned hierarchical representation, the sorting codes that are contained in the sorting code ranges that are defined in the various hierarchical levels are ascertained consecutively. The entirely defined sorting code range contains all of the sorting codes that are encompassed by the sorting code ranges in the individual levels.

For example, if the above-mentioned 5,3,3 hierarchy is provided and if mailpieces associated with sorting codes between 12345 100 000 and 12345 101 999 are to be diverted into the compartment having the compartment number 1, then this is indicated as follows within the list block 24 of the sorting plan.

```
<SL>
    <LEVEL>5<\LEVEL>
    <LEVEL>3<\LEVEL>
    <LEVEL>3<\LEVEL>
    <SLCODE>
        <FROM> 12345 <\FROM>
        <SLCODE>
            <FROM> 100 <\FROM>
            <TO> 101 <\TO>
            <SLCODE>
                <CPMT>
                    <CPMTNO> 1 <\CPMTNO>
                <\CPMT>
                <FROM> 000 <\FROM>
                <TO> 999 <\TO>
            <\SLCODE>
        <\SLCODE>
    <\SLCODE>
<\SL>
```

On the basis of the above-mentioned meaning of the various positions of the sorting code, the specified sorting code range can be interpreted to the effect that these are mailpieces whose delivery address contains the postal code 12345, that are located in the street sections 100 and 101 of the corresponding delivery district group and for which the number corresponding to the last three positions of the house number is between 0 and 999.

Correspondingly, the sorting code range, which is specified in the following XML representation (without an indication of the sorting compartments), contains all of the sorting codes for mailpieces whose delivery address contains the postal code 12345, that are located in the street sections 100 and 101 of the corresponding delivery district group and for which the number corresponding to the last three positions of the house number is in a house number range from 4 to 560.

```
<SL>
    <LEVEL>5<\LEVEL>
    <LEVEL>3<\LEVEL>
    <LEVEL>3<\LEVEL>
    <SLCODE>
        <FROM> 12345 <\FROM>
        <SLCODE>
            <FROM> 100 <\FROM>
            <TO> 101 <\TO>
            <SLCODE>
                <FROM> 004 <\FROM>
                <TO> 560 <\TO>
            <\SLCODE>
        <\SLCODE>
    <\SLCODE>
<\SL>
```

Here, it should be pointed out that this expression specifically does not indicate the sorting code range from 12345 100 004 to 1234 102 560; the sorting code 12345 101 999, for example, does not lie in the sorting code range that is defined in this manner.

Another example of a hierarchy that has proven to be especially advantageous, aside from the 5,3,3 hierarchy, is a 5,6 hierarchy consisting of two hierarchical levels. The upper hierarchical level is associated with the first five positions of the eleven-digit sorting code and the lower hierarchical level is associated with the last six positions of the sorting code.

If, for example, when the 5,6 hierarchy is used, mailpieces associated with sorting codes between 12345 100 000 and 12345 101 999 are to be diverted into the compartment having the compartment number 1, then this is indicated as follows within the list block 24 of the sorting plan.

```
<SL>
    <LEVEL>5<\LEVEL>
    <LEVEL>6<\LEVEL>
    <SLCODE>
        <CPMT>
            <CPMTNO> 1 <\CPMTNO>
        <\CPMT>
        <FROM> 12345 <\FROM>
        <SLCODE>
            <FROM> 100 000 <\FROM>
            <TO> 101 999 <\TO>
        <\SLCODE>
    <\SLCODE>
<\SL>
```

It should be pointed out that sorting code ranges can only be represented with just one indication of an interval for each level provided if the partial codes in the lowest level are completely encompassed by the interval, such as is the case with the 5,3,3 hierarchy, for example, within the interval 12345 100 000 to 12345 101 999, or if the upper and lower interval limits of a code interval only differ in terms of the positions that are associated with the lowest hierarchical level such as is the case, for example, with the code interval from 12345 100 004 to 12345 101 560. Otherwise, it might be necessary to have several interval specifications for the individual levels.

An example of this is the code interval from 12345 100 004 to 12345 108 560. This can be divided into the following partial intervals of the above-mentioned type:

12345 100 004 to 12345 100 999,
12345 101 000 to 12345 107 999 and
12345 108 000 to 12345 108 560.

If a 5,3,3 hierarchy is provided and if mailpieces associated with sorting codes from this code interval are to be diverted into the compartment having the compartment number 1, then this is indicated as follows within the list block 24 of the sorting plan.

```
<SL>
    <LEVEL>5<\LEVEL>
    <LEVEL>3<\LEVEL>
    <LEVEL>3<\LEVEL>
    <SLCODE>
        <FROM> 12345 <\FROM>
        <SLCODE>
            <FROM> 100 <\FROM>
            <SLCODE>
                <CPMT>
                    <CPMTNO> 1 <\CPMTNO>
                <\CPMT>
                <FROM> 004 <\FROM>
                <TO> 999 <\TO>
            <\SLCODE>
        <SLCODE>
            <FROM> 100 <\FROM>
            <TO> 107 <\TO>
            <SLCODE>
                <CPMT>
                    <CPMTNO> 1 <\CPMTNO>
```

-continued

```
                <\CPMT>
                <FROM> 000 <\FROM>
                <TO> 999 <\TO>
            <\SLCODE>
        <\SLCODE>
        <SLCODE>
            <FROM> 108 <\FROM>
            <SLCODE>
                <CPMT>
                    <CPMTNO> 1 <\CPMTNO>
                <\CPMT>
                <FROM> 000 <\FROM>
                <TO> 560 <\TO>
            <\SLCODE>
        <\SLCODE>
    <\SLCODE>
<\SL>
```

Moreover, on the basis of the elements E and O optionally indicated in an element SLCODE, it can be indicated whether the indicated sorting code range encompasses only sorting codes with even-numbered elements (element E present) or odd-numbered elements (element O present) of the indicated interval.

This possibility is especially provided with an eye towards the fact that normally, all of the house numbers on one side of a street are even and on the other side of the street, they are odd. Hence, it is possible to indicate sorting code ranges that contain exclusively sorting codes for street addresses that are located on one side of the street in prescribed street sections of one delivery district group.

For example, if it is provided that mailpieces that are delivered within a delivery district group with the postal code 12345 and with a street section within this delivery district group with the number 100 and in a house number range from 0 to 500 on the side with the odd-numbered house numbers are sorted into the sorting compartment having the number 1, this is indicated in the XML representation as follows:

```
<SL>
    <LEVEL>5<\LEVEL>
    <LEVEL>3<\LEVEL>
    <LEVEL>3<\LEVEL>
    <SLCODE>
        <FROM> 12345 <\FROM>
        <SLCODE>
            <FROM> 100 <\FROM>
            <SLCODE>
                <FROM> 000 <\FROM>
                <TO> 500 <\TO>
                <O\>
            <\SLCODE>
        <\SLCODE>
    <\SLCODE>
<\SL>
```

Below, it will be shown how the sorting plans or sorting lists indicated in the above-mentioned manner in an XML document are evaluated for the sorting of mailpieces, i.e. how, on the basis of the above-mentioned hierarchically structured sorting lists, the sorting compartment is determined into which a mailpiece having a certain sorting code is diverted.

Here, it is provided that, in a first step, it is first checked which one of the sorting code ranges indicated in the topmost hierarchical level encompasses the prescribed sorting code.

Thus, for example, if the sorting list is structured according to the 5,3,3 hierarchy, first of all, a determination is made of the postal code range indicated in the topmost hierarchical level which encompasses the postal code contained in the prescribed sorting code.

In the next step, it is determined which of the sorting code ranges indicated in the next-lower hierarchical level encompasses the prescribed sorting code, whereby here, the only sorting code ranges taken into account are the ones that are associated with the sorting code range indicated in the top level. These are the sorting code ranges that are indicated in the elements SLCODE which are contained in the element SLCODE indicating the sorting code range determined in the first step.

Thus, in case of a 5,3,3 hierarchy, it is determined which of the street section ranges indicated for the postal code range in the first step encompasses the street section specified in the sorting code.

If in this step, it is determined that the sorting code does not belong to one of the sorting code ranges indicated in the second hierarchical level, then the evaluation is terminated and the mailpiece is diverted into the sorting compartment that is associated with the sorting code range determined in the first step.

The subsequent steps are carried out in an analogous manner for the existing subsequent hierarchical levels, whereby, for the sorting, the relevant sorting compartment is the one that is associated with the sorting code range that is indicated in the lowest hierarchical level for which the prescribed sorting code belongs to the indicated sorting code range.

For example, in case of a 5,3,3 hierarchy, this can optionally be followed by another step in which it is determined which of the house number ranges indicated for the previously determined street sections with the postal code determined in the first step encompasses the house number information contained in the sorting code. The mailpiece is then diverted into the compartment associated with the house number range that encompasses the number that is contained in the sorting code and that corresponds to the last three positions of the house number.

If the house number information contained in the sorting code does not belong to any of the checked house number ranges, then the sorting compartment that is associated with the street section determined in the preceding step becomes relevant for the sorting of the mailpiece.

During the encoding of the delivery address in the encoding device, it can happen that parts of the address are not recognized and encoded since, for example, they are illegible. In this case, the sorting code remains incomplete and contains only the positions that can be determined within the scope of the encoding. As a rule, however, at least the postal code can be recognized and encoded in the OCR device or in the video encoding device.

In the case of mailpieces with incomplete sorting codes, it is provided within the scope of an exemplary embodiment of the present invention that the above-mentioned stepwise evaluation of the sorting plan is carried out until the evaluation is carried out in the hierarchical level that is associated with positions of the sorting code that are still completely contained in the sorting code.

If the sorting code contains, for example, only a postal code and if a hierarchy is provided whose topmost hierarchical levels are associated with the first five positions of the sorting code, then the mailpiece is diverted into the compartment that is associated with the postal code range that encompasses the postal code contained in the sorting code.

In this manner, it is achieved that even mailpieces whose delivery address could only be incompletely encoded are sorted. Within the scope of the outgoing sorting, mailpieces whose postal code have been recognized are thus conveyed to the destination region where they can be associated with a delivery address, if applicable, manually.

The sorting plans structured in the manner according to an exemplary embodiment of the present invention are transmitted to a sorting machine, preferably in the XML format by the system in which the sorting plans were generated.

The advantage of sorting plans executed in the XML format is especially the fact that they can be interpreted across multiple systems, so that the sorting plans can be generated independently of the specific type of sorting machine. Therefore, as far as the sorting machine is concerned, only the number of existing compartments has to be taken into account when the sorting plans are being generated.

Depending on they type of sorting machine, however, it is also possible that it cannot process sorting plans in the XML format. In this case, it is preferably provided that the sorting plans generated in the form of an XML document are converted by a conversion system into a format that can be interpreted by the sorting machine.

The conversion system can be a component of the system for generating the sorting plans or a component of the sorting machine. Moreover, it can also be an autonomous system that is preferably connected via a data network to the system for generating the sorting plans and to the sorting machine.

The invention claimed is:

1. A method for sorting a mailpiece, the mailpiece being diverted into a sorting compartment of a sorting machine as a function of a sorting code associated with the mailpiece, where several sorting code ranges are each associated with a sorting compartment, the method comprising:

associating at least one first sorting code range indicated in a first hierarchical level with at least another sorting code range indicated in a lower hierarchical level, the other sorting code range being a subrange of the first sorting code range;

checking consecutively for the sorting code ranges associated with each other whether the sorting code belongs to the sorting code range; and diverting the mailpiece into the sorting compartment that is associated with the last sorting code range for which the sorting code belongs to the sorting code range, the mailpiece being diverted into the sorting compartment that is associated with the sorting code range indicated in the first hierarchical level, if it is determined that the sorting code does not belong to one of the sorting code ranges indicated in the lower hierarchical level.

2. The method according to claim 1, wherein the sorting code comprises a numerical code and wherein a sorting code range encompasses all of the sorting codes in which a number, which comprises at least one digit located in a prescribed position in the sorting code, lies within a prescribed interval.

3. The method according to claim 2, wherein a first sorting code range is associated with another sorting code range encompassing all of the sorting codes, which belong to the first sorting code range and in which a number that is made up of at least one digit that is located in at least one position of the sorting code following the prescribed position lies within a prescribed interval.

4. The method according to claim 3, wherein the sorting code is a p-digit numerical sorting code having the form $n_1 \ldots n_p$ wherein $n_i \in \{0, \ldots, 9\}$ and $1 \leqq I \leqq p$, and wherein a first sorting code range encompasses all of the sorting codes in which the number $n_1 \ldots n_x$ is not smaller than a first number and not greater than a second number, wherein x is an integer where $1 \leqq x < p$.

5. The method according to claim 2, wherein the first sorting code range is associated with at least another sorting code range that encompasses all of the sorting codes of the first sorting code range in which the number $n_{x+1} \ldots n_y$ is not smaller than a first number and not greater than a second number, where y is an integer where $x < y \leqq p$.

6. The method according to claim 1, wherein the first sorting code range is associated with several additional sorting code ranges that each are a subrange of the sorting code range, and for the additional sorting code ranges it is checked in a prescribed sequence, whether the sorting code belongs to the sorting code ranges.

7. The method according to claim 6, wherein the additional sorting code ranges associated with the first sorting code range are pairwise disjunctive.

8. The method according to claim 1, wherein several first sorting code ranges are each associated with at least another sorting code range, the first sorting code ranges being pairwise disjunctive.

9. The method according to claim 1, wherein the sorting code comprises an eleven-digit numerical sorting code whose first five digits correspond to a postal code contained in the delivery address of the mailpiece, whose next three digits correspond to a street section contained in the delivery address and whose last three digits represent the last three positions of a house number contained in the delivery address.

10. The method according to claim 9, wherein a first sorting code range encompasses all of the sorting codes in which the postal code lies within a prescribed postal code range.

11. The method according to claim 10, wherein a second sorting code range associated with the first sorting code range encompasses all of the sorting codes of the first sorting code range in which the street section corresponds to one of several prescribed street sections.

12. The method according to claim 11, wherein the second sorting code range is associated with a third sorting code range that encompasses all of the sorting codes of the second sorting code range in which the number formed from the last three digits of the house number lies within a prescribed house number range.

* * * * *